US008690469B2

(12) United States Patent
Merzon

(10) Patent No.: US 8,690,469 B2
(45) Date of Patent: Apr. 8, 2014

(54) BINDER WITH REMOVABLE PORTFOLIO

(76) Inventor: Adam Merzon, Greenwich, CT (US)

( * ) Notice: Subject to any disclaimer, the term of this patent is extended or adjusted under 35 U.S.C. 154(b) by 386 days.

(21) Appl. No.: 11/767,735

(22) Filed: Jun. 25, 2007

(65) Prior Publication Data

US 2007/0297849 A1 Dec. 27, 2007

Related U.S. Application Data

(60) Provisional application No. 60/805,740, filed on Jun. 25, 2006.

(51) Int. Cl.

| | |
|---|---|
| ***B42F 3/00*** | (2006.01) |
| ***B42F 13/40*** | (2006.01) |
| ***B42F 13/00*** | (2006.01) |
| ***A45C 1/08*** | (2006.01) |
| ***A45C 1/02*** | (2006.01) |
| ***A45C 3/06*** | (2006.01) |

(52) U.S. Cl.
USPC ..... 402/4; 402/70; 402/73; 402/76; 402/77; 402/78; 402/502; 150/111; 150/113

(58) Field of Classification Search
USPC ..... 402/4, 73, 70, 76–78, 502; 150/111, 150/113; 190/110
See application file for complete search history.

(56) References Cited

U.S. PATENT DOCUMENTS

| | | | | | |
|---|---|---|---|---|---|
| 84,564 | A | * | 12/1868 | Matthews | 281/19.1 |
| 716,647 | A | | 12/1902 | Sheperd | |
| 1,806,246 | A | | 4/1930 | Feldman et al. | |
| D182,059 | S | * | 2/1958 | Chase | D3/233 |
| 2,989,998 | A | | 6/1961 | Harris | |
| 3,351,064 | A | * | 11/1967 | Cohn | 402/4 |
| 4,180,114 | A | | 12/1979 | Katz | |
| D320,411 | S | * | 10/1991 | Wyant | D19/27 |
| D322,458 | S | * | 12/1991 | Wiberg | D19/27 |
| 5,240,340 | A | * | 8/1993 | Lynch et al. | 402/79 |
| 5,738,460 | A | * | 4/1998 | Flynn | 402/73 |
| 6,000,873 | A | | 12/1999 | Burton | |
| 6,017,062 | A | * | 1/2000 | White | 402/73 |
| 6,371,679 | B1 | * | 4/2002 | Peleman | 402/73 |
| 6,547,283 | B1 | * | 4/2003 | Moor | 281/44 |
| 6,739,784 | B1 | * | 5/2004 | Tims et al. | 402/73 |
| 7,021,853 | B2 | * | 4/2006 | Hall et al. | 402/73 |
| 7,478,965 | B2 | * | 1/2009 | Shapiro | 402/73 |
| 2005/0016647 | A1 | * | 1/2005 | Carey et al. | 150/113 |

* cited by examiner

*Primary Examiner* — Kyle Grabowski
(74) *Attorney, Agent, or Firm* — Law Office of Stephen Cannavale

(57) ABSTRACT

The present invention is directed to an item holding assembly that may include a binder and portfolio with one releasably attached to the other enabling quick and easy separation for use of one independent of the other. In a preferred embodiment, binder and portfolio panels can overlie one another, particularly when releasably engaged in a manner that releasably attaches them. A flap, such as part of the panel or the panel of one is received in a pocket formed in the panel of the other to facilitate and preferably provide releasable attachment.

8 Claims, 12 Drawing Sheets

BINDER WITH REMOVABLE PORTFOLIO

CROSS-REFERENCE TO RELATED APPLICATION

This application claims the benefit of U.S. Provisional Application No. 60/805,740, filed Jun. 25, 2006, the entire content of which is incorporated by reference herein.

FIELD OF THE INVENTION

The present invention relates to binders, and more specifically to a binder with a releasably attached portfolio that is equipped with an internal expandable file arrangement and method of releasable attachment.

BACKGROUND OF THE INVENTION

Both binders and portfolios are commonly utilized organizational components commonly used by a variety of individuals including students, teachers, professors and business people. Both binders and portfolios allow a user to work such that the individual can be more prepared and focused for the task at hand. In the past, binder arrangements and portfolios have been manufactured and sold separately.

In most cases, the binder is a large bulky item, comprised of two covers, a spine and an internal central ring portion. In most cases, a variety of specialized components such as folders, loose-leaf and other supplies are attached to the ring portion of the binder. The different compartments are commonly designed to house a plurality of different organizational components. For instance, some of the binder compartments may hold materials related to all of a student's classes as well as school supplies and some extracurricular materials such as CDs and DVDs. As noted above, due to its use as a single source for storage and organization of a school or work supplies, the binder is often a somewhat large and awkward item that is not always easily manipulable. Due to its large size, the binder is not always an appropriate accessory in certain situations. For example, during interviews, presentations or other more intimate settings, the binder may not be an appropriate accessory. Its large size can be awkward and may be clumsily carried.

The portfolio, in contrast is typically a smaller, less bulky item when compared to the traditional binder. The portfolio is commonly comprised of two covers that define a smaller internal compartment for receiving individual documents such as, papers, resumes, or other projects. Individuals often prefer to bring the less bulky portfolio into meetings presentations, or interviews. The portfolio is less cumbersome for the individual, yet provides organization for smaller works.

SUMMARY OF THE INVENTION

The current invention provides for an item holding assembly with a binder and a portfolio, wherein one of the binder and portfolio are removably carried by the other one of the binder and portfolio.

These and other advantages of this invention will become apparent from the following detailed description, which, taken in conjunction with the annexed drawings, discloses the preferred embodiment of the invention.

Figure 1:
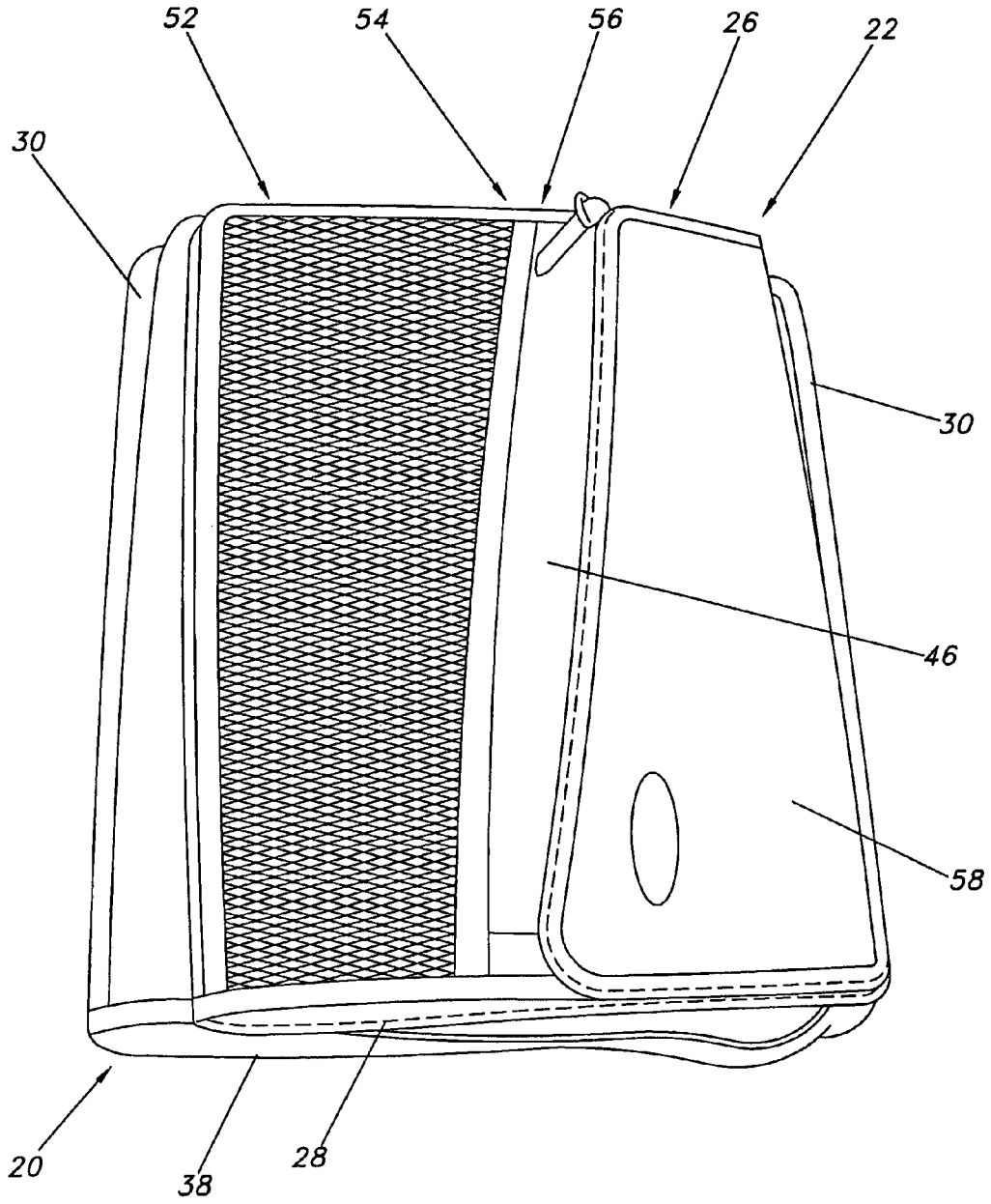
FIG. 1 is a top plan view of a binder with a removable portfolio releasably attached to the binder.

Before explaining embodiments of the invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE INVENTION

FIGS. 1-12C illustrate a binder 20 with a portfolio 22 removably carried one by the other in a manner that permits the portfolio 22 to be quickly and easily removed from the binder 20 and used. The portfolio 22 has preferably at least one internal compartment 24 (FIG. 7) with access to the compartment 24 preferably controlled by a releasable closure 26. The portfolio 22 may have an outer panel 28 that preferably releasably engages an outer panel 30 of the binder 20. In the preferred embodiment shown in the drawing figures, a portion 32, which is formed on one or both of the outer panels 28 and 30, is releasably received in a sleeve 34 (FIG. 8) formed in the other one of the panels 28 and 30. A fastening arrangement 36 preferably is employed to help releasably keep the portfolio 22 attached to the binder 20. For example, the fastening arrangement 36 helps keep the panel portion 32 seated in the sleeve 34, thereby helping to keep the portfolio 22 attached to the binder 20.

The binder 20 has a pair of outer panels 30 and 38 interconnected by a spine 40 (FIG. 2) preferably each formed of a substantially self-supporting or rigid sheet of material that can be optionally covered with a material such as a fabric, cloth, synthetic material, leather or the like. With reference to FIG. 3, disposed inside the binder 20 is preferably a releasable item carrier 42 that may be a reclosable ring-type clamp arrangement 44. In the preferred embodiment shown in the drawing figures, the ring-type clamp arrangement 44 is, preferably, a three ring-type clamp arrangement that is carried by the spine 40.

Figure 2:
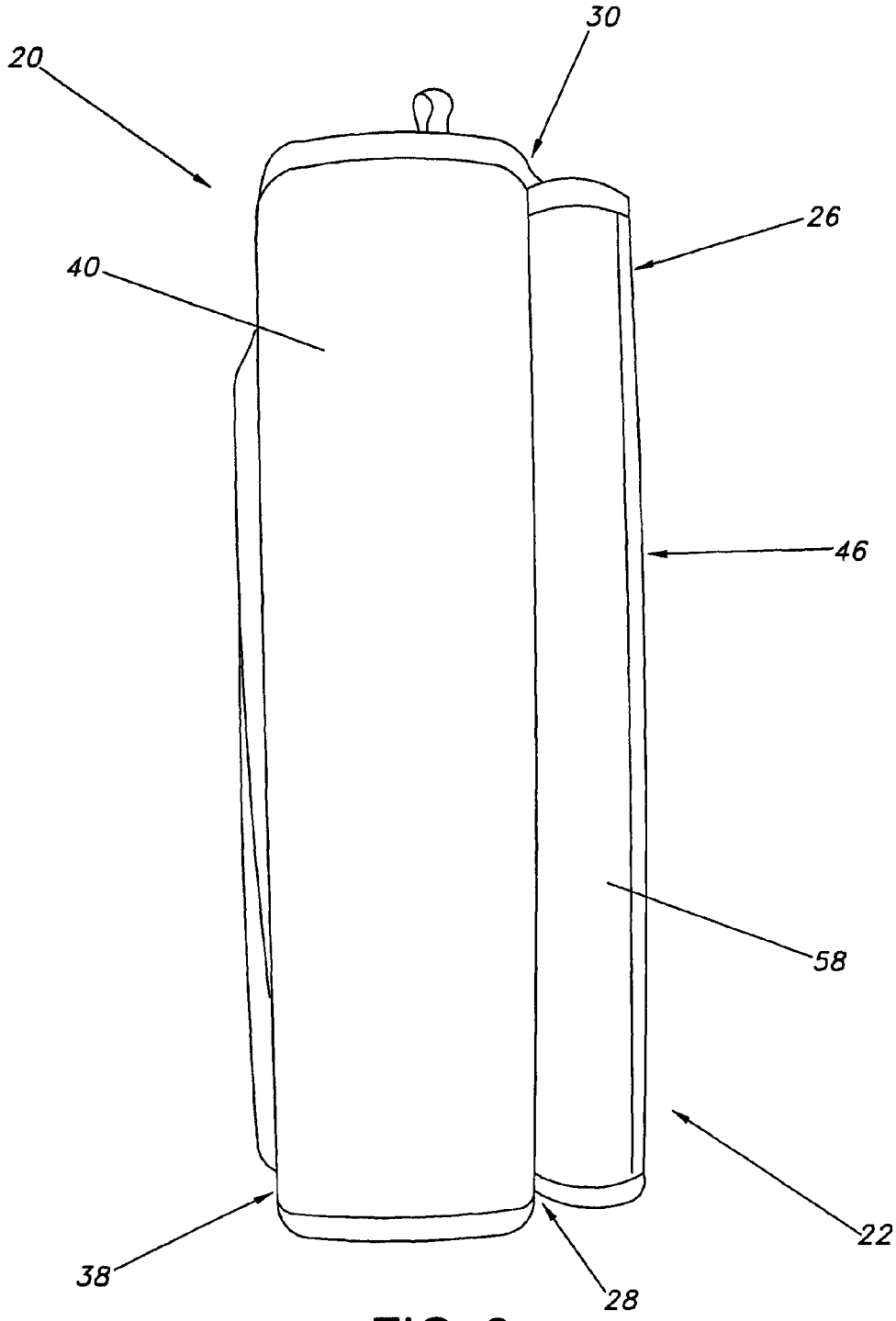
FIG. 2 is an end elevational view of the binder with portfolio removably attached to the binder.
Figure 3:
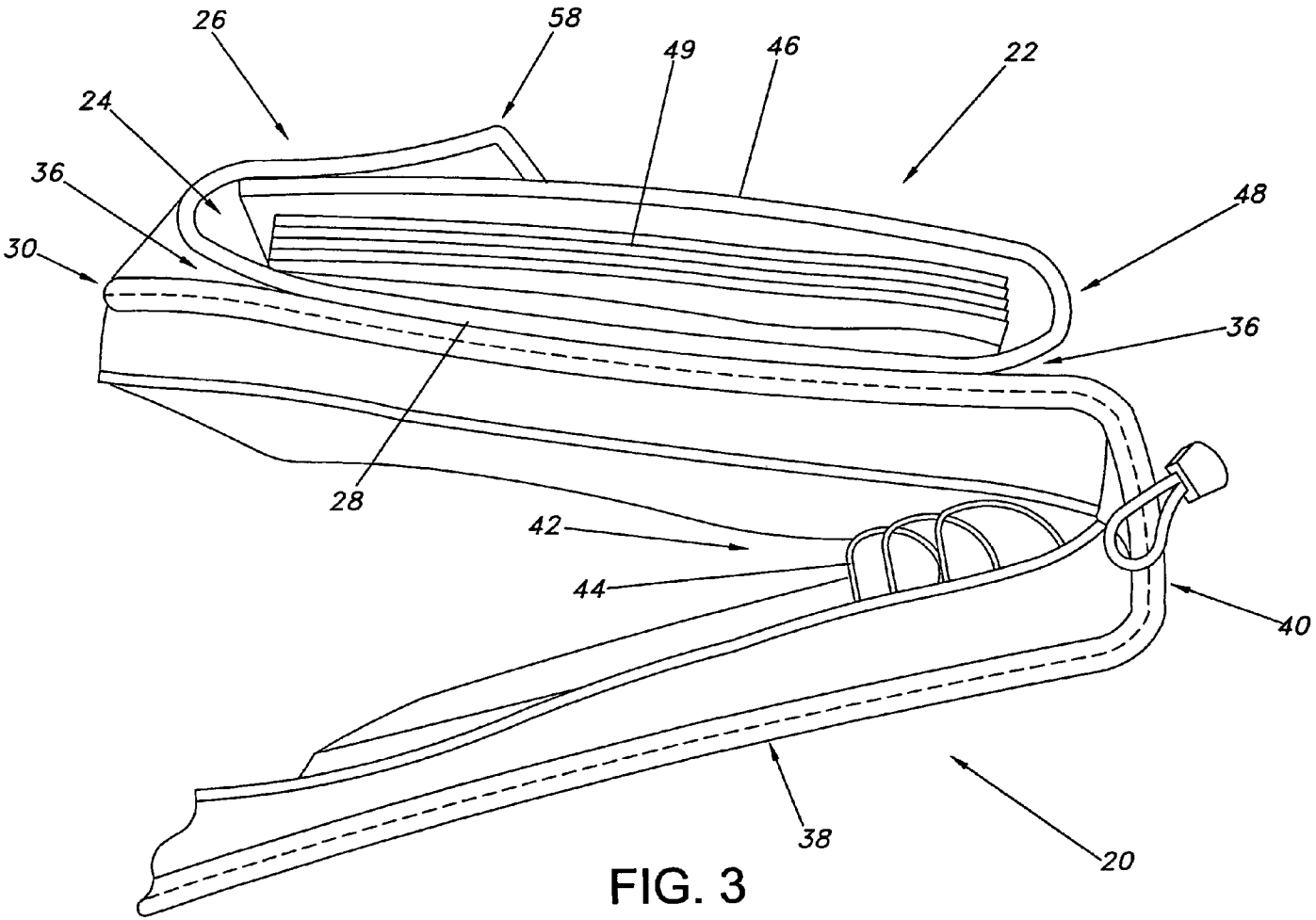
FIG. 3 is a first side elevational view of the binder open with the portfolio removably attached to the binder.
Figure 4:
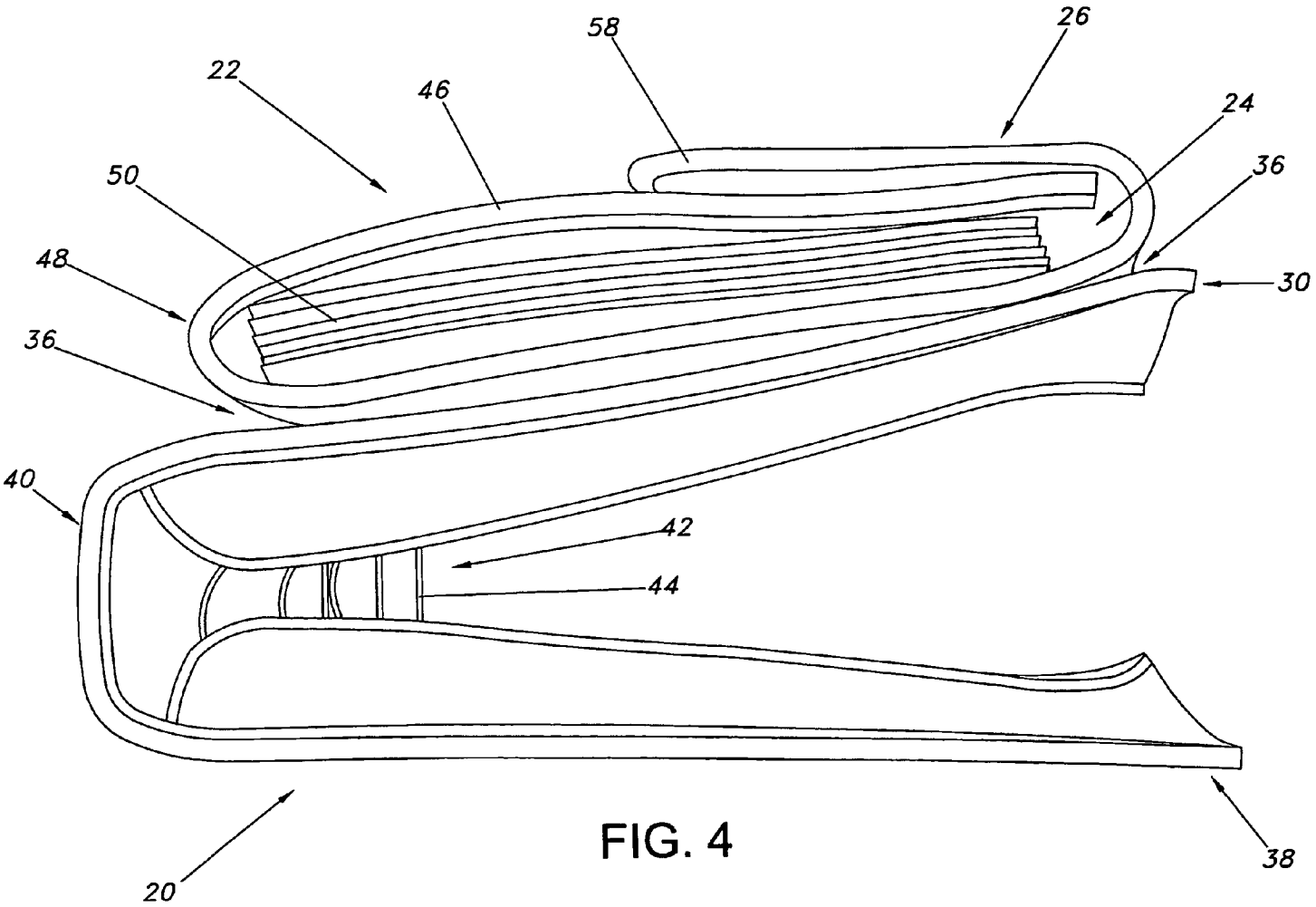
FIG. 4 is a second side elevational view of the binder open with the portfolio removably attached to the binder.
Figure 5:
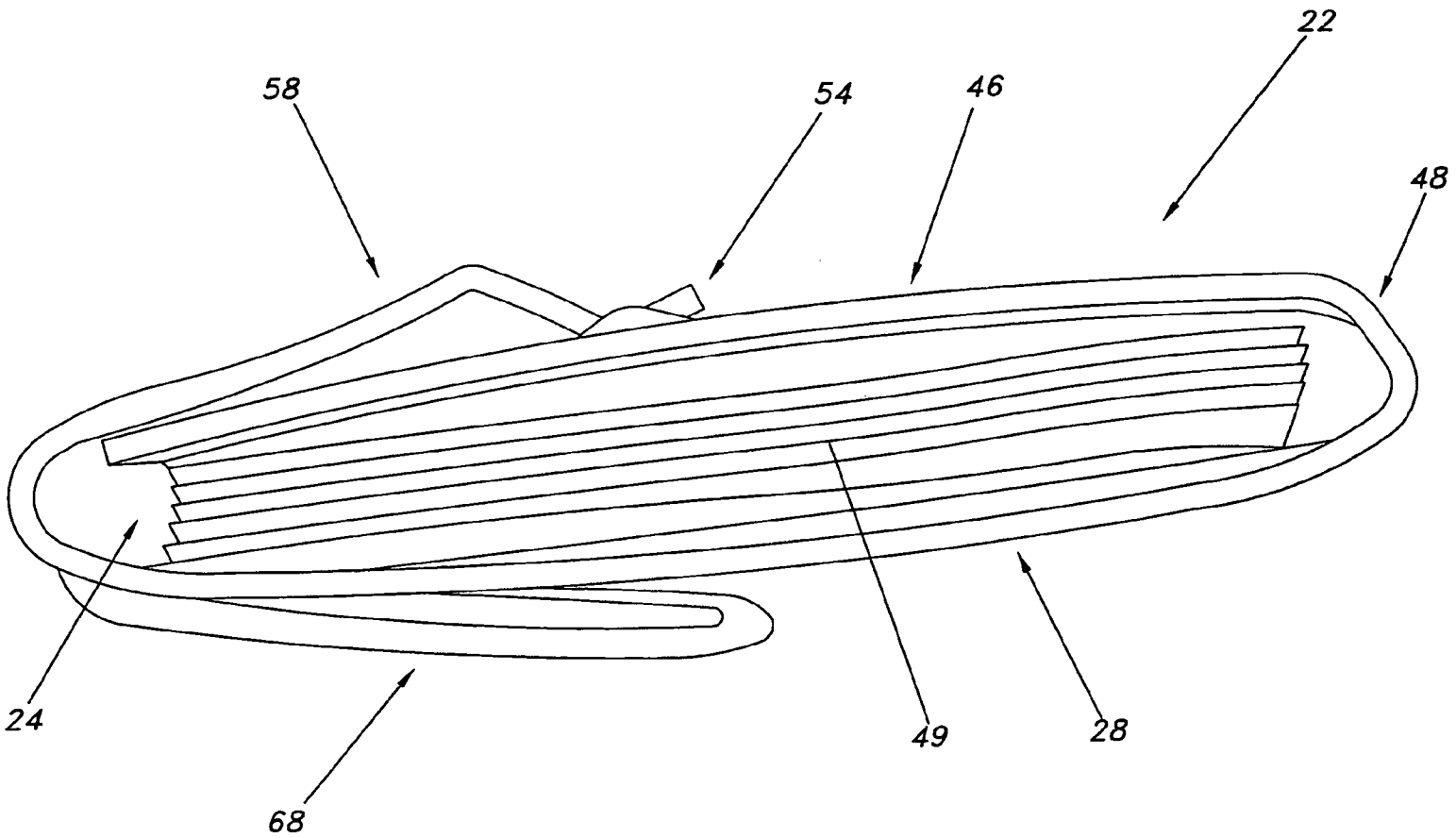
FIG. 5 is a side view of the portfolio.
Figure 6:
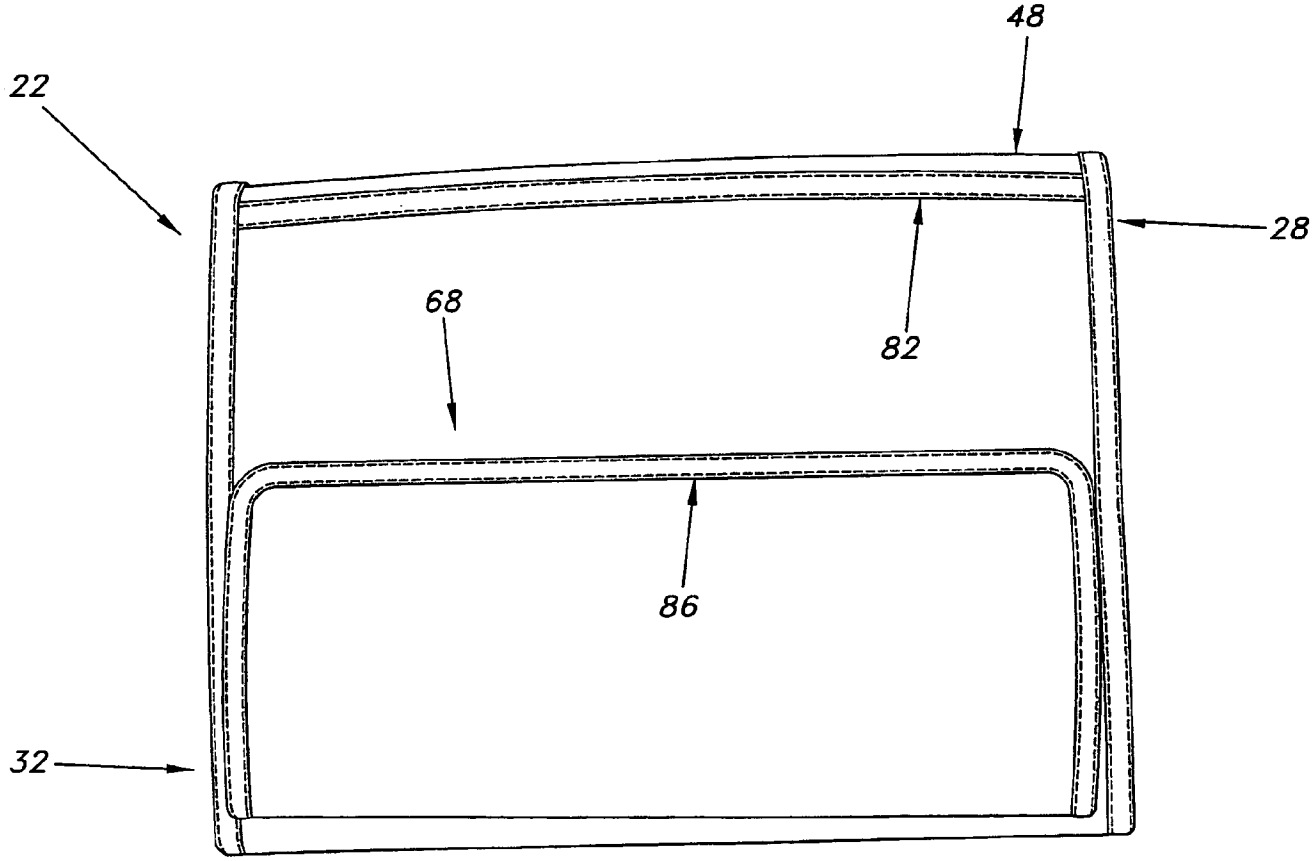
FIG. 6 is a top plan view of the portfolio.

As can be seen in FIGS. 2 and 3, the portfolio 22 preferably has a pair of outer panels 28 and 46 interconnected by a spine 48. A single sheet of material may define spine 48 and the panels 28 and 46. A pair of sidewalls 49 and 50 may be provided to interconnect the panels 28 and 46 adjacent or along their side edges such that the internal portfolio compartment 24 may be defined between the panels 28 and 46 and the sidewalls 49 and 50. In the preferred embodiment shown in FIGS. 3 and 4, each sidewall is of pleated constructed and can be supported by gussets (not shown) if desired.

The outwardly facing outer portfolio panel 46 may include a mesh pocket 52 having a reclosable closure 54 that preferably is a zipper 56 that permits objects to be releasably retained in the pocket 52 when the zipper 56 is closed and removed from the pocket 52 when the zipper 56 is opened. The outer panel 46 also may include an arrangement for releasably retaining the releasable closure 26 in a closed position that prevents removal of objects received in the internal portfolio compartment 24. The releasable closure 26 preferably is a cover flap 58 forming part of binder-facing portfolio panel 28. The cover flap 58 may be formed to overlap the panel 46 in a closed position (FIG. 3). The cover flap 58 preferably releasably engages part of an outer surface 60 of the outer portfolio panel 46 in a manner that releasably retains the flap 58 in a closed position until a user may manually disengage the flap 58 during opening.

Figure 7:
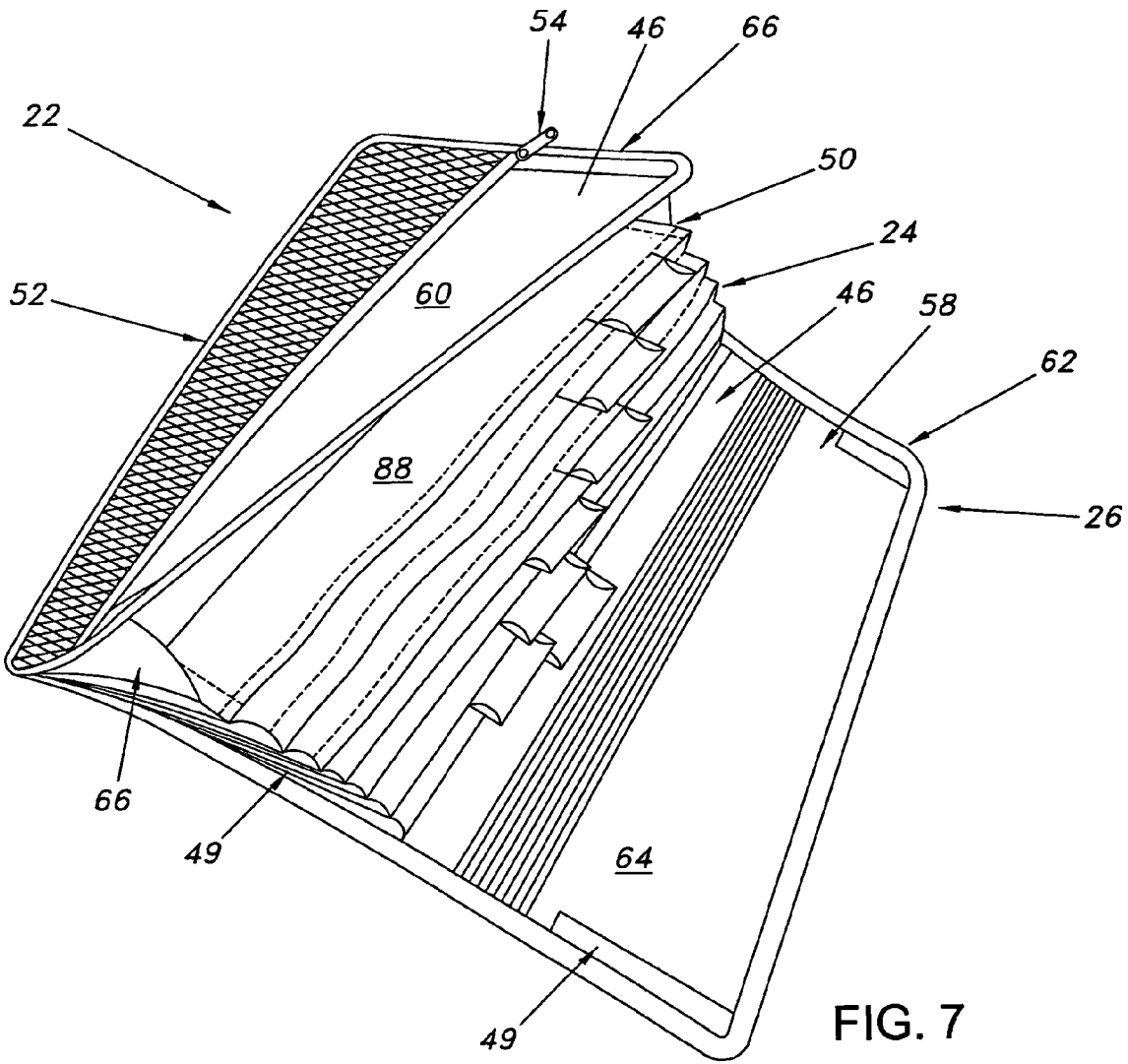
FIG. 7 is a perspective view of the portfolio with the portfolio shown in an open configuration.
Figure 8:
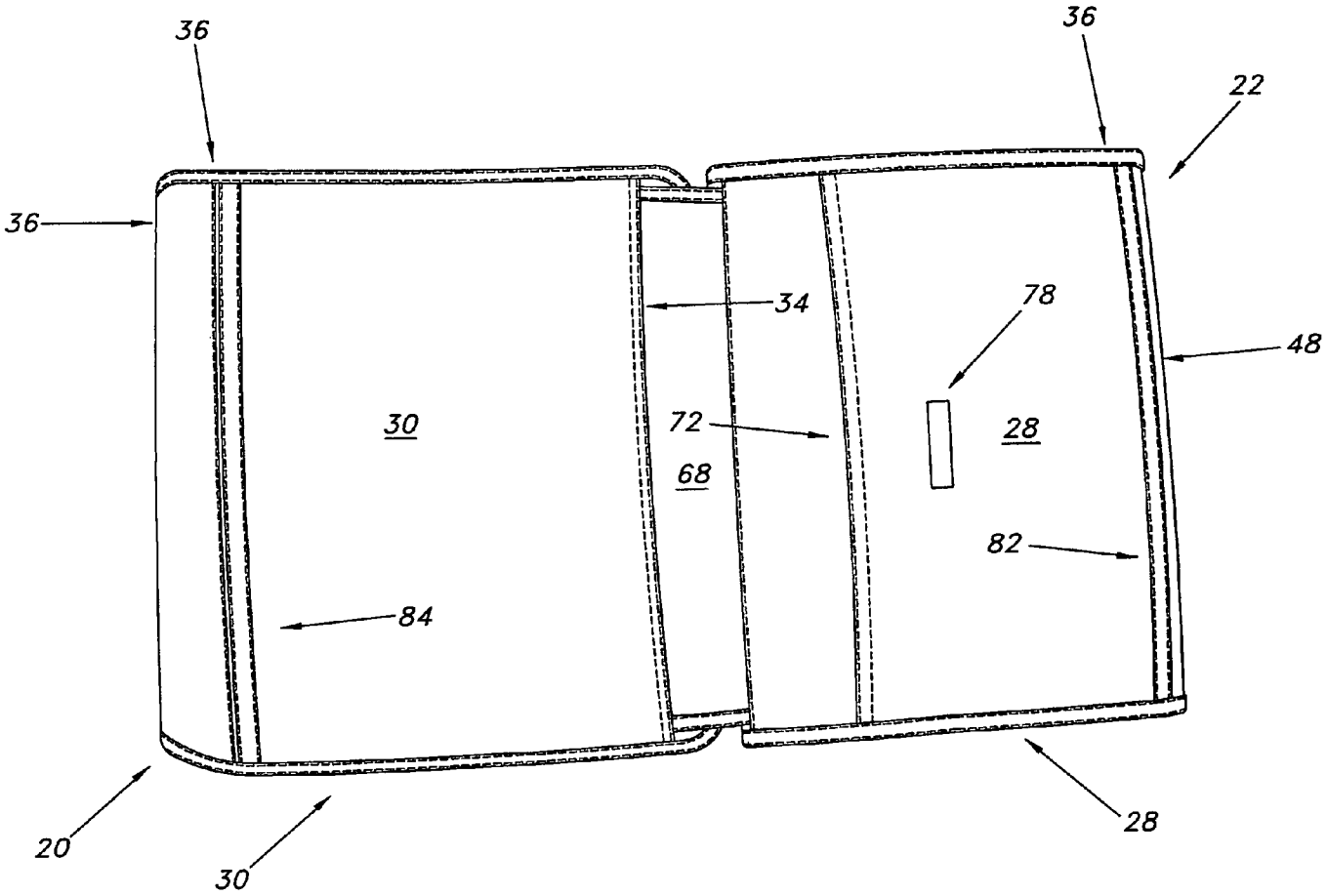
FIG. 8 is a top plan view of the binder and portfolio with a flap of the portfolio inserted into a sleeve formed in the binder.
Figure 9:
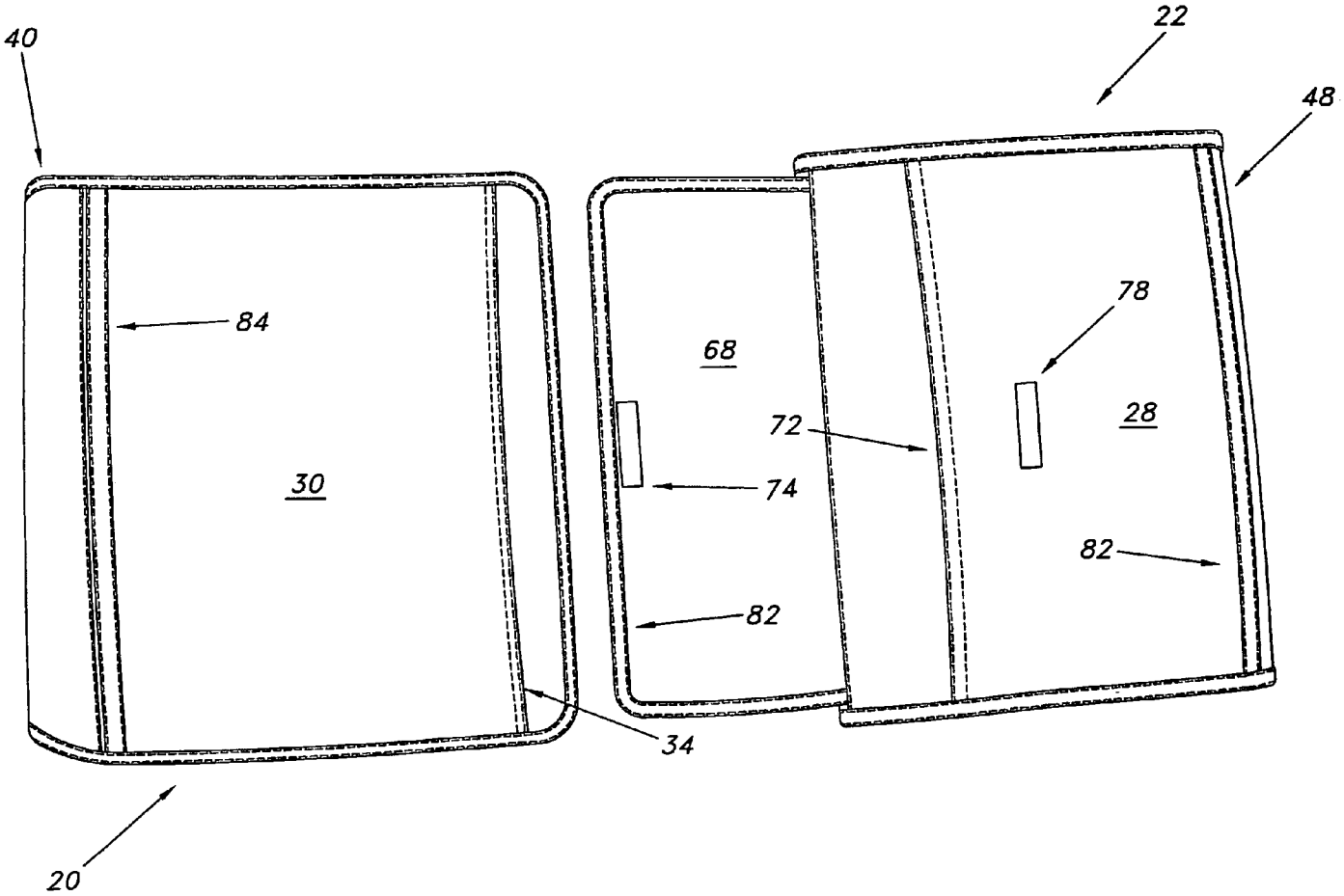
FIG. 9 is a top exploded view of the binder and portfolio with a flap of the portfolio removed from the sleeve formed in the binder.
Figure 10:
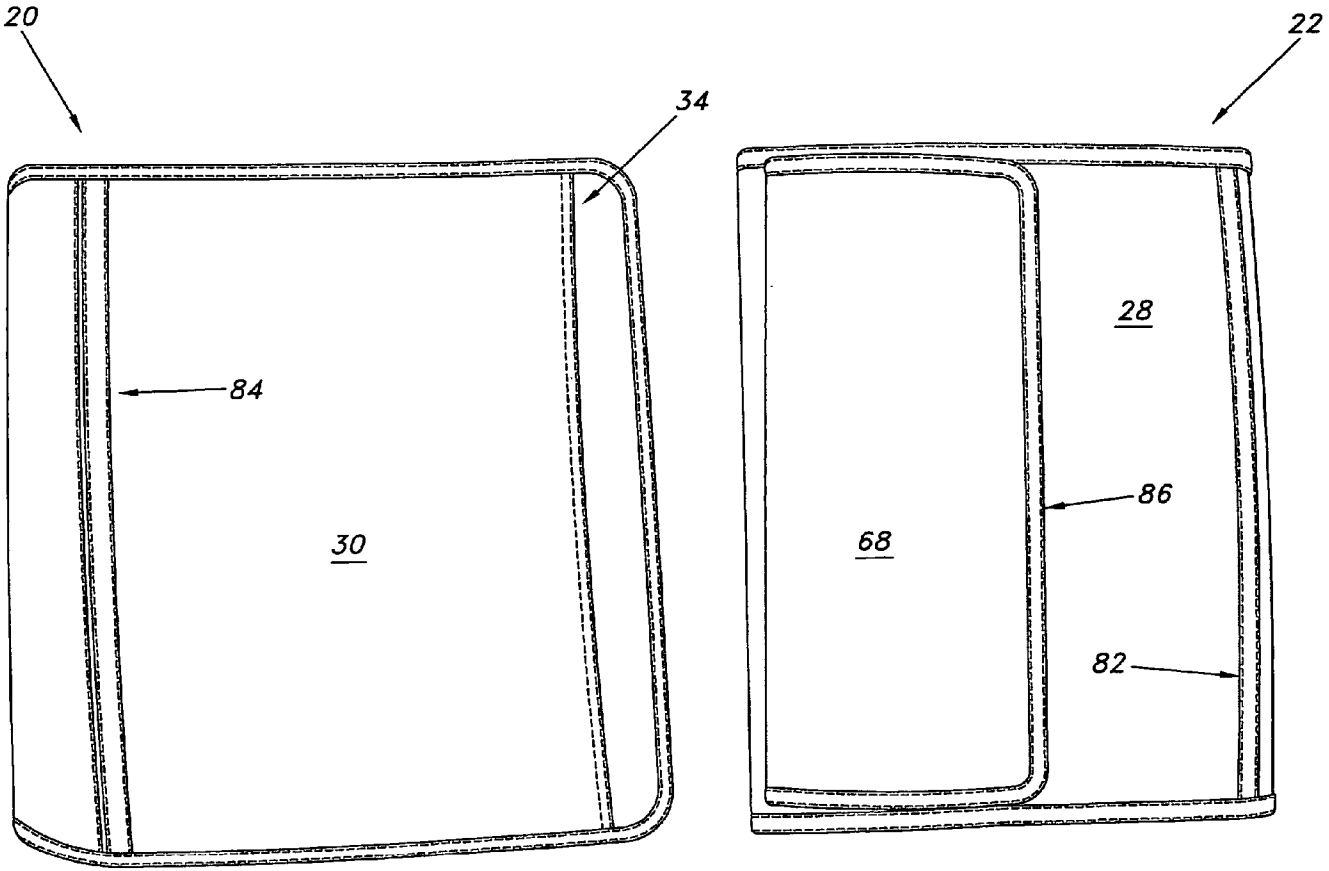
FIG. 10 is a side by side top plan view of the binder and portfolio respectively.
Figure 11A:
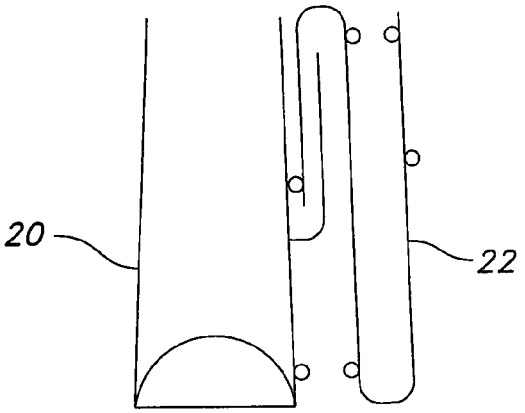
FIGS. 11A to 11D are cross-sectional views of other embodiments of the present invention.
Figure 11B:
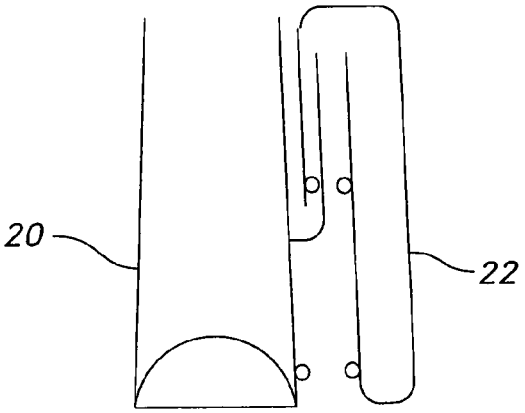
Figure 11C:
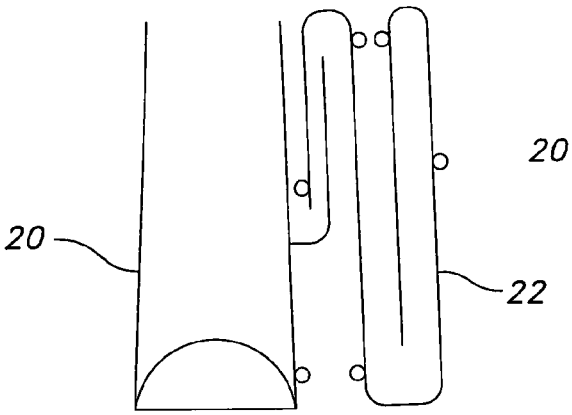
Figure 11D:
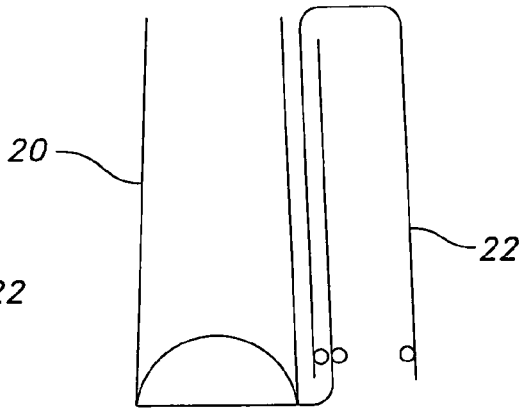

With reference to FIG. 7, the portfolio cover flap 58 preferably has at least one elongate strip of a hook and loop fastener material 62 attached to its inner surface 64 that releasably engages an elongate strip of a complementary hook and loop fastener material 66 attached to the outer surface 60 of the outer panel 46. In a preferred embodiment, there is a plurality of spaced apart and generally parallel elongate hook and loop fastener strips 66 attached to the outer panel 46 with each strip located along an outer edge of the panel 46. There is also preferably a plurality of spaced apart and generally parallel hook and loop fastener strips 62 attached to the inner cover flap surface 64 arranged such that each strip 62 overlies and engages a corresponding outer panel mounted strip 66 when the cover flap 58 is urged against the outer panel 46.

As is shown in FIG. 7, the cover flap 58 of a preferred embodiment overlies the internal portfolio compartment 24, which preferably includes at least one divider 88 that can be disposed in the compartment 24. The divider arrangement 88 can cooperate with an internal compartment 24 that is of accordion or expandable construction.

The portfolio 22 is preferably removably attached to one of the binder panels 30 such that the inner panel 28 of the portfolio 22 preferably lies against binder panel 30 such that the panels 28 and 30 are substantially parallel with one another. They preferably lie in engagement with one another when the portfolio 22 is releasably attached to the binder 20.

The portfolio 22 preferably has a second cover flap 68 that extends outwardly in a direction different than that of the cover flap 58. The second cover flap 68 preferably overlies a mouth or opening 70 of a second pocket 72 carried by portfolio panel 28 with the flap 68 including a strip of hook and loop fastener material 74 attached to its inner surface 76 that may releasably engage a strip of complementary hook and loop fastener material 78 attached to an outer surface 80 of panel 28. When the portfolio 22 is detached from the binder 20, its second cover flap 68 can be releasably retained closed against the outer surface 80 of panel 28 via engagement between hook and loop fastener strips 74 and 78.

The cover flap 68 may define the portion 32 which releasably engages the binder 20. In particular, the cover flap 68 is preferably telescopically received in the sleeve 34 formed in the outer panel 30 of the binder 20. To help keep the cover flap 68 in the sleeve 34, various forms of fastening arrangements 36 may be utilized. By way of non-limiting example, the outer surface 80 of the inner portfolio panel 28 may include an elongate generally longitudinally extending strip of hook and loop fastener material 82 that releasably engages an elongate longitudinally extending strip of complementary hook and loop fastener material 84 disposed on the outer surface 86 of outer panel 30 of the binder 20. Preferably, the hook and loop fastener strip 82 extends generally parallel to a longitudinally extending elongate outer or peripheral edge 86 of the flap 68.

To detach the portfolio 22 the binder 20, a user may manually apply force to urge the portfolio panel 28 away from the binder panel 30 to overcome any fastening arrangement 36 which may be utilized, such as by applying force adjacent or along hook and loop fastener material strips 82 and 84 until they disengage one another. Thereafter, relative movement between the binder 20 and portfolio 22 away from one another in a direction generally parallel to one or both overlapping panels 28 and 30 preferably withdraws portfolio panel 28 from the sleeve 34 in the binder panel 30. Advantageously, the binder 20 and the portfolio 22 may be attached and detached without the need for opening either the binder 20 or the portfolio 22.

Various alternatives are contemplated as being within the scope of the following claims particularly pointing out and distinctly claiming the subject matter regarded as the invention. For instance, FIGS. 11A to 11D disclose different configurations of the cover flap 68 for different embodiments. For these embodiments, either the portfolio or the binder is altered slightly to create a different combination from the configuration described above. Specifically, the embodiments disclose a double functioning cover flap 68 which can slide into the sleeve 34 and also secure the portfolio when the portfolio is used separately from the binder. Also note that the portfolio may include two additional sets of fasteners, one fastener set to grasp the portfolio to the binder and the other fastener set to close the portfolio when the portfolio is attached to the binder.

Figure 12C:
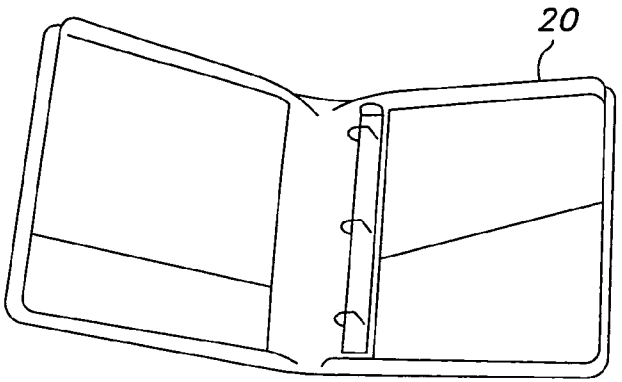
FIG. 12C is a perspective view of FIG. 12A with the binder in an open configuration, disclosing the binder rings.
Figure 12B:
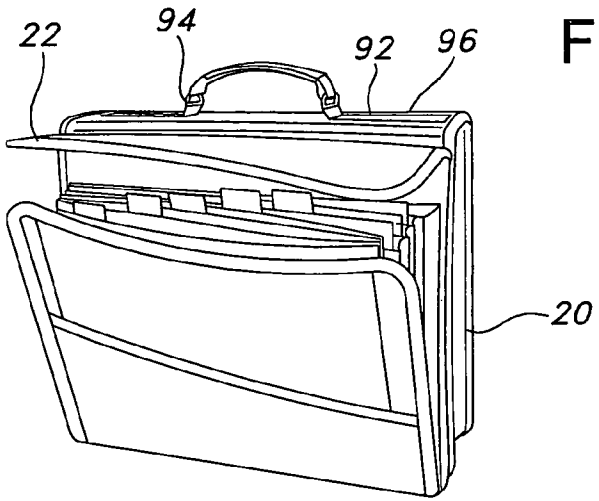
FIG. 12B is a perspective view of FIG. 12A with the portfolio in an open configuration, disclosing the inner tab folders therewithin.
Figure 12A:
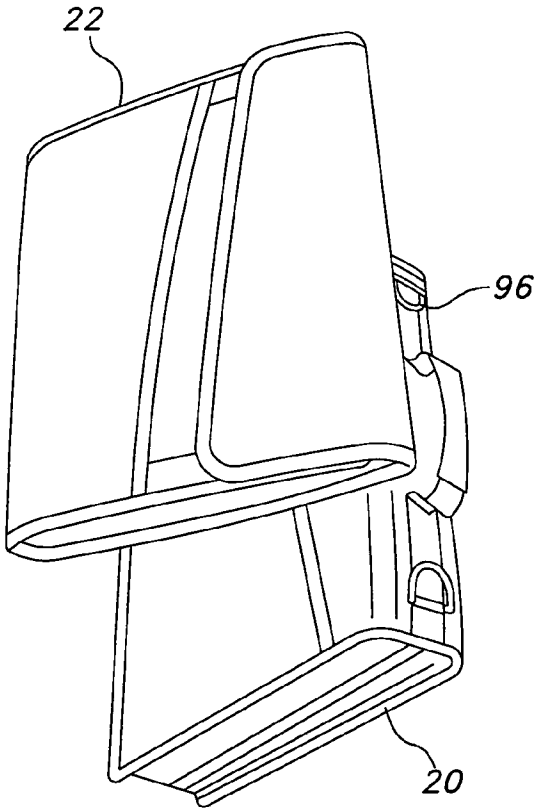
FIG. 12A is a perspective view of yet another embodiment of the present invention with the portfolio detached from the binder.

Further, the binder or the portfolio may have additional features such as a handle 90 as shown by FIGS. 12A through 12C. The handle 90 can be provided on a continuous extended strip to strengthen the handle 90. In the alternative, as shown, the handle 90 can be attached to a pair of extended strips 92 by a set of coupling devices 94. The handle 90 may also be provided with a grip enhancing padding or a cushion for comfort or strength. Further, the strips 92 may include a pair of shoulder strap coupling devices 96 for a shoulder strap or a harness. Another feature of this particular binder is the inner folders of the binder 20 can be accessed from a direction opposite of the sleeve opening. It is therefore also to be understood that, although the foregoing description and drawings describe and illustrate in detail one or more preferred embodiments of the present invention, to those skilled in the art to which the present invention relates the present disclosure will suggest many modifications and constructions as well as widely differing embodiments and applications without thereby departing from the spirit and scope of the invention including any and all such inventions claimed herein. Accordingly, the particularly disclosed scope of the invention is set forth in the following claims.

What is claimed is:

1. An item holding assembly comprising: (a) a binder; and (b) a portfolio, wherein the binder and portfolio are removably attached to the other one of the binder and portfolio, and wherein said binder has a spine and a pair of binder opposable covers, and an outer sleeve accessible by a slot along an edge opposite said spine in one of said pair of opposable covers, and said portfolio has a pair of portfolio opposable covers and wherein said portfolio further includes an articulating flap extending from one of said portfolio opposable covers that is removably inserted into said outer sleeve of one of said pair of binder opposable cover through said slot and wherein said portfolio is carried on the exterior of said outer sleeve the portfolio having an opening and a pair of cover flaps for covering the opening wherein one of said cover flaps extends outwardly in a direction different from that of the other cover flap.

2. The item holding assembly of claim 1, wherein the portfolio is releasably attached to the binder.

3. The item holding assembly of claim 2 further comprising a plurality of strips facilitating releasable attachment of the portfolio to the binder.

4. The item holding assembly of claim 2 further comprising a plurality of hook and loop fastener strips that releasably attach the portfolio to the binder.

5. The item holding assembly of claim 2 wherein an outer surface of one of said binder opposable covers and an outer surface of one of said portfolio opposable covers overlies and are in direct contact with one another when the portfolio is releasably attached to the binder.

6. A portable container combination for holding materials, the combination comprising: a first case with a spine an a pair of first case opposable covers, and an outer sleeve accessible by a slot along an edge opposite said spine in one of said pair of opposable covers; and a second case has a pair of second case opposable covers and wherein said second case further includes an articulating flap extending from one of said second case opposable covers that is removably inserted into said outer sleeve of one of said pair of first case opposable covers through said slot and wherein said portfolio is carried on the exterior of said outer sleeve the portfolio having an opening and a pair of cover flaps for covering the opening wherein one of said cover flaps extends outwardly in a direction different from that of the other cover flap.

7. A portable container combination according to claim 6, wherein said first case and said second case includes fastener joints to allow a user to manually attach and detach said first and second cases.

8. A portable container combination according to claim 6, wherein the combination is configured to provide detachment without opening up either said first case or said second case.

* * * * *